United States Patent [19]

Kesting

[11] Patent Number: 4,856,238

[45] Date of Patent: Aug. 15, 1989

[54] PREFABRICATED PART FOR CONSTRUCTING A BUILDING AIR-CONDITIONED VIA ITS WALLS

[76] Inventor: Lorenz Kesting, Holzheck 21, 4600 Dortmund-Eving, Fed. Rep. of Germany

[21] Appl. No.: 129,045

[22] Filed: Dec. 7, 1987

Related U.S. Application Data

[62] Division of Ser. No. 737,740, May 28, 1985, Pat. No. 4,715,163.

[30] Foreign Application Priority Data

Feb. 20, 1985 [DE] Fed. Rep. of Germany ..... 3505841

[51] Int. Cl.[4] ..... E04C 1/40; E04B 2/42; E04F 17/04

[52] U.S. Cl. ..... 52/90; 52/173 R; 52/220; 52/303; 52/505; 52/607; 98/31.6

[58] Field of Search ..... 52/303, 305, 607, 173 R, 52/505, 220, 90; 98/31, 31.6

[56] References Cited

U.S. PATENT DOCUMENTS

| | | | |
|---|---|---|---|
| 769,257 | 9/1904 | Edwins | 52/505 X |
| 1,086,031 | 2/1914 | Davis | 52/303 |
| 1,131,437 | 3/1915 | Stockman | 98/31 |
| 1,399,275 | 12/1921 | Roberts | 52/505 X |
| 1,401,588 | 3/1922 | Myers | 52/303 |
| 1,582,735 | 4/1926 | Cooper | 52/607 |
| 1,607,583 | 11/1926 | Bader | 52/505 |
| 1,785,499 | 12/1930 | Sayers | 52/505 |
| 1,968,680 | 7/1934 | Grothaus | 52/303 |
| 2,029,586 | 2/1936 | Rendoff | 52/607 |
| 2,181,814 | 11/1939 | Knapp | 52/405 |
| 2,192,691 | 11/1938 | Knapp . | |
| 2,530,940 | 11/1958 | Dahlin | 52/303 |
| 2,811,850 | 11/1957 | Clary | 52/303 |
| 4,286,420 | 9/1981 | Pharmakidis | 52/303 |
| 4,312,164 | 1/1982 | Walt | 52/405 |
| 4,334,394 | 6/1982 | Mader | 52/405 |
| 4,380,887 | 4/1983 | Lee | 52/405 |
| 4,628,653 | 12/1986 | Nash | 52/405 |

FOREIGN PATENT DOCUMENTS

| | | | |
|---|---|---|---|
| 565291 | 11/1923 | France | 52/505 |
| 607252 | 6/1926 | France | 52/505 |
| 634941 | 3/1928 | France | 52/303 |
| 905471 | 12/1945 | France | 52/505 |
| 136854 | 2/1930 | Switzerland | 52/505 |

*Primary Examiner*—John E. Murtagh

*Attorney, Agent, or Firm*—Andrus, Sceales, Starke & Sawall

[57] ABSTRACT

A large-format artificial brick has vertical air channels extending therethrough. Recesses on the top and bottom of the brick form additional air circulating channels for a heating or cooling medium. In a building formed with such large-format bricks, a blower is located in the basement and connected to the vertical passages by a manifold.

12 Claims, 7 Drawing Sheets

Figure 1:
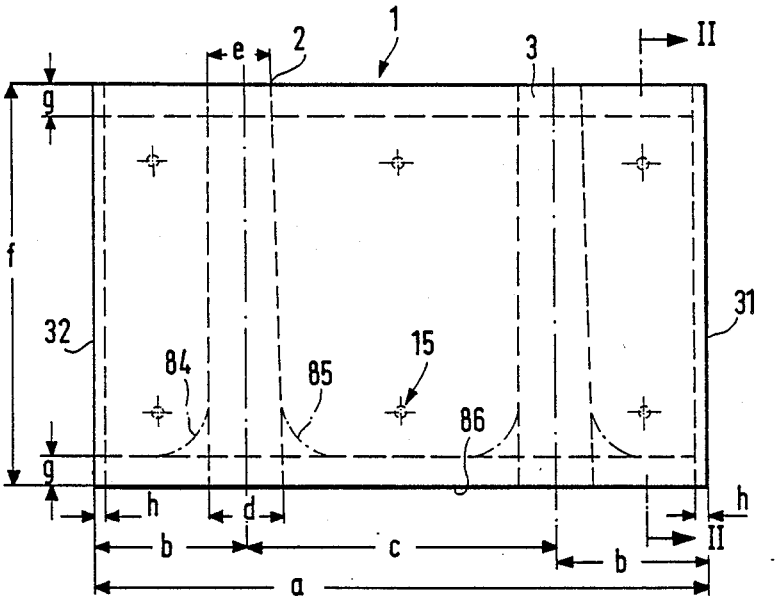

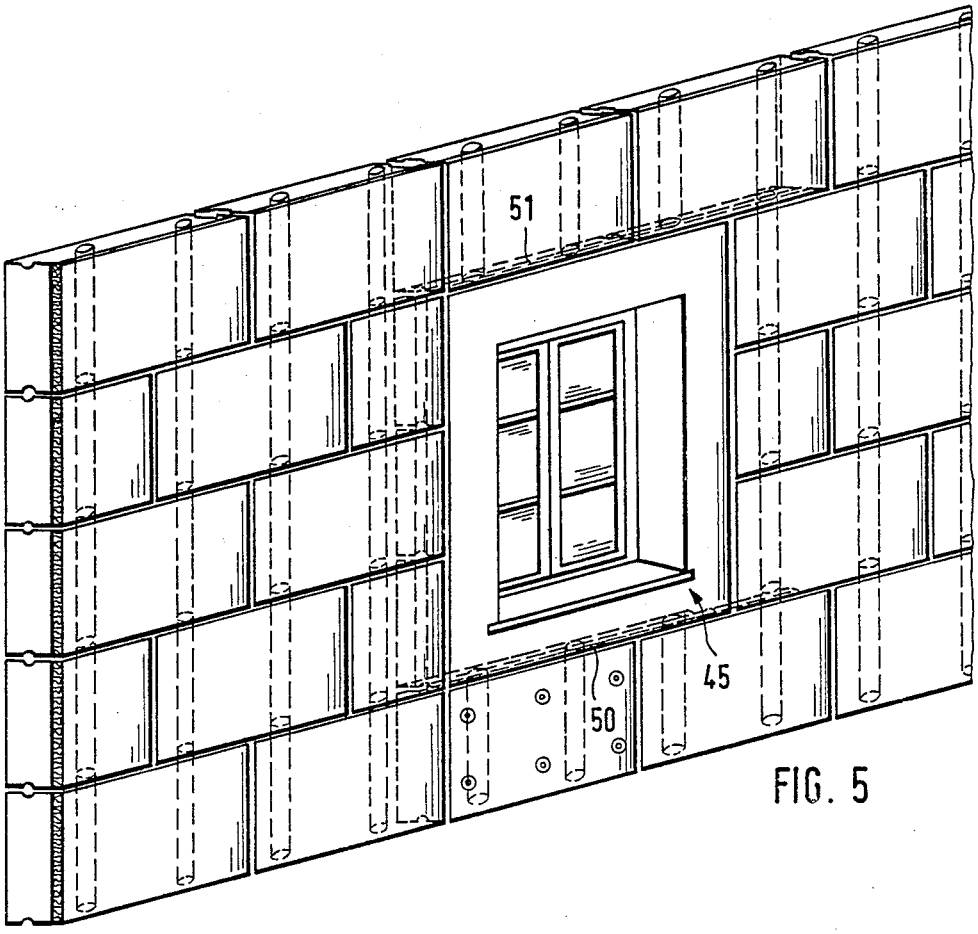
FIG. 5
FIG. 6
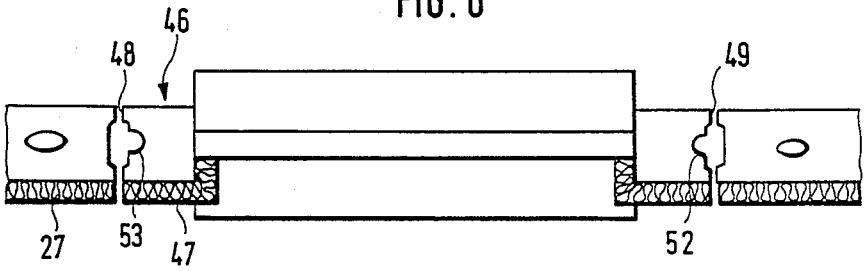

PREFABRICATED PART FOR CONSTRUCTING A BUILDING AIR-CONDITIONED VIA ITS WALLS

This application is a divisional application of U.S. patent application Ser. No. 06/737,740 filed May 28, 1985, now U.S. Pat. No. 4,715,163.

The present invention relates to a prefabricated part for constructing a building air-conditioned via its walls.

The partial air-conditioning of a building, in particular a residential building, usually requires the building to be heatable in the winter if it is located in a climatic zone involving low outdoor temperatures, and to be capable of being at least cooled in climatic zones involving high outdoor temperatures. The full air-conditioning of a building requires heating and cooling as the seasons change. If the medium which is used to supply heat and possibly to eliminate heat is conducted not via radiators or cooling devices but through wall channels provided at least in the outer walls of the building, but possibly in its ceilings as well, this results in heat exchange surfaces as large as the wall or ceilings in the air-conditioned rooms of the building, thereby allowing for the possibility of achieving even temperatures distribution in the rooms, on the one hand, and relatively small differences in the advance flow and return temperatures of the heating medium, on the other hand, which in turn allow for favorable efficiency factors of the air-conditioning and make it economical to use reverse cycle heating systems in some cases. In such air-conditioned buildings, wall designs which allow for a gaseous medium for transporting heat are in general considerably more favorable than buildings in which heat exchange pipes or tubes must be used to conduct a liquid heat transporting medium, which is in particular warm or hot water. This is based not least on the danger of leaks in the conduit system and the difficulties in eliminating the damage to the building caused thereby. High costs are also involved for installing pipes which are required by a liquid heat medium.

The heat transporting medium, which is therefore preferably gaseous, can be conducted in accordance with the invention in open circulation. However, since considerable heat losses may occur in this case due to the small difference between the inlet temperature and the outlet temperature of the medium, at least when the building is being heated, the invention relates in particular to the construction of walls in which a closed circulation of the medium takes place. It is not a system operated by natural pull which is involved here, in spite of the vertical arrangement of the wall channels and the horizontal channels, but rather forced circulation of the gaseous medium. Since, in accordance with the invention, the walls are heated and a good efficiency factor is to be achieved at the same time, the outer walls of the building are generally insulated in order to prevent heat from flowing outside to the greatest possible degree.

The erection of a building designed according to such considerations using prefabricated parts reduces the work to be done at the construction site to the absolute minimum and allows for certain subassemblies to be produced in an industrialized fashion, which is ultimately less expensive. If these subassemblies are one-story-high wall elements or even an uninterrupted outer skin, there are a number of disadvantages as compared with masonry consisting of artificial bricks which must be erected on the construction site. For instance, the reinforcement of the wall elements as required in large panel construction but which is superfluous in the case of brickwork not only increases costs, but also adds even more to the considerable weight of the wall elements, which are already difficult to transport and install. Brickwork also prevents a number of sealing difficulties which frequently cannot be avoided in large panel construction from arising at all. The relatively high labor costs for qualified craftsmen and costs for the material required for the masoning can be considerably reduced in the case of the masonry consisting of standard bricks, as was the only customary kind formerly, by using large-format artificial bricks which nevertheless do not require reinforcement. Different dimensions are used here, but large-format artificial bricks made of chalky sandstone, clay brick, pumice stone and concrete are quite customary, the height of the bricks used ranging, for example, from 23.8 cm to 50.3 cm and the length from 2.4 m to 4.2 m.

The invention assumes a known air-conditioned building (German Offenlegungsschrift 23 46 906). The outer walls and/or the inner walls of this building are penetrated by the vertical channels extending from the basement up to the roof for the gaseous medium to flow through, the flow of the medium being regulatable using restrictors. However, it is extremely difficult to erect such a building. Furthermore, the design of vertical channels in the walls has turned out to be alone no guarantee of the desired even tmeperature distribution over the walls. The known building therefore does not meet either the requirement of even heat distribution, which is necessary in terms of the comfort of the air-conditioning, or that of a favorable efficiency factor of the air-conditioning, which is crucial as far as the economy of such a building is concerned.

The invention provides a prefabricated part for constructing the walls of a building of the type assumed as being known, which part reduces the work to be performed at the construction site without giving rise to the difficulties involved in large panel construction, thereby increasing the economy of construction in this manner and also achieving a degree of uniformity of the wall temperatures which ensures the necessary comfort in the rooms and allows for a favorable efficiency factor of the air-conditioning.

The favorable results of masoning using large-format artificial bricks are utilized in accordance with the invention to erect the building, whereby the large-format artificial bricks, being designed to have a plurality of recesses each forming a section of adjacent vertical wall channels, allow at the same time, according to the invention, for the distance between the vertical heating channels to be reduced to such an extent as to result in an even temperature distribution in the bricks and over the wall. Further, the even temperature distribution over the entire wall of the building is further improved, if desired, by using the large format of the artificial bricks to form horizontal connecting channels by aid of the semitubular depressions in the brick surfaces limiting the horizontal brickwork joints, into which the vertical wall channels open out. The resulting temperature balance in the vertical flow of the medium due to the transverse flow in the wall bricked up in this manner ultimately leads to the desired even temperature distribution over the wall being achieved via the brick and joint surfaces.

The invention does not jeopardize the economy of masoned walls already achieved using large-format artificial bricks but further increases it. For at the construction site the channels can be kept free of joint mortar without any great difficulty due to the large format of the bricks, and be already used to conduct a heating medium while the building is being erected. This allows for winter construction, whereby the finished vertical or horizontal channels in the partially erected walls are subjected to hot-air blowers. For it is easy to connect pipes or tubes to the available openings of the channels and remove them again.

The economy during the erection of the building can be further increased substantially by other features of this invention. In an embodiment of the invention, the outer insulation of the walls conducting the medium, which is crucial for the economy of the air-conditioning, is already completed to a large extent during its industrialized production so that only little work remains to be done at the construction site. An even further-reaching degree of rationalization of the work at the construction site is provided by another embodiment of the invention because not only does it allow for expedient attachment of the thermal insulation to the artificial brick, the means of attachment may also be used at the construction site for attaching a warm or cold facade.

The best results have proved to be attained with the invention when the recesses are positioned in a prescribed manner. For it is possible in this case to create a distance between the vertical heating channels which is even across the entire width of the wall in spite of the vertical joints. This is extremely favorable for achieving an even wall temperature.

It is of course expedient to give the wall channels a design which is as smooth as possible in order to reduce the flow resistance in the walls of the building which the medium flows through. This is only possible in general, due to the large format of the inventive artificial bricks, if at least the larger recesses, i.e. the recesses for the wall channels, are kept open on the inside using mandrels. The embodiment having tapered recesses is therefor expedient because it considerably facilitates the extraction of the mandrels out of the mass of the large-format brick.

Other features of the invention create more favorable conditions for conducting the gaseous heating medium in the finished brickwork above a horizontal joint in each case using the recesses having funnel-shaped extensions for the vertical wall channels.

It is also recommended to provide the vertical joint sides of the inventive artificial bricks with uninterrupted depressions. This produces joggling of the bricks with the joint mortar filling in the vertical joints, thereby considerably increasing the stability of the brickwork.

Other features facilitate mechanized walling up, in particular the walling up of the above-described inventive prefabricated parts.

The details, further features and other advantages of the inventive prefabricated parts and of a building walled up of such prefabricated parts can be found in the following description of embodiments of the invention with reference to the figures in the drawing. These show:

FIG. 1 a front view of a prefabricated part according to the invention.

Figure 2:
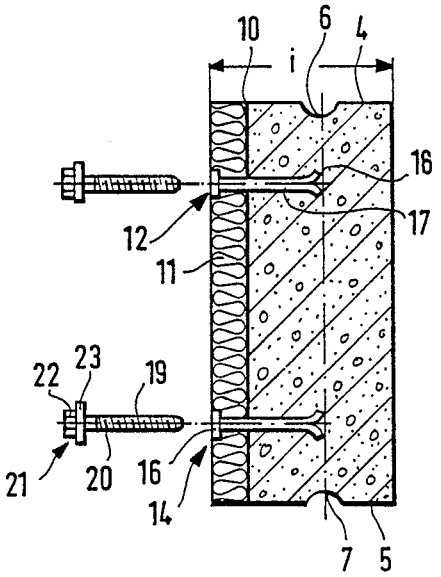

FIG. 2 a side view of the object of FIG. 1 in cross-section II—II.

Figure 3:
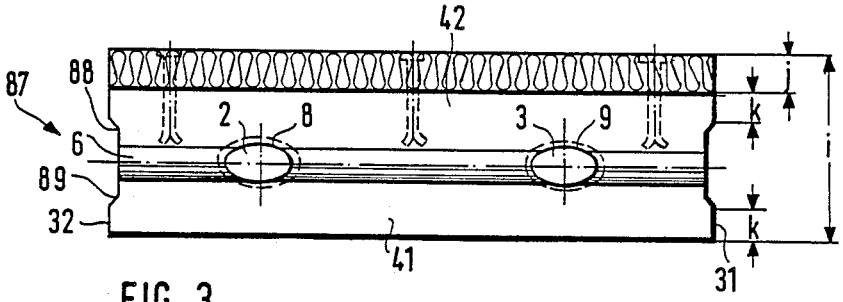

FIG. 3 a top view of the object shown in FIGS. 1 and 2.

Figure 4:
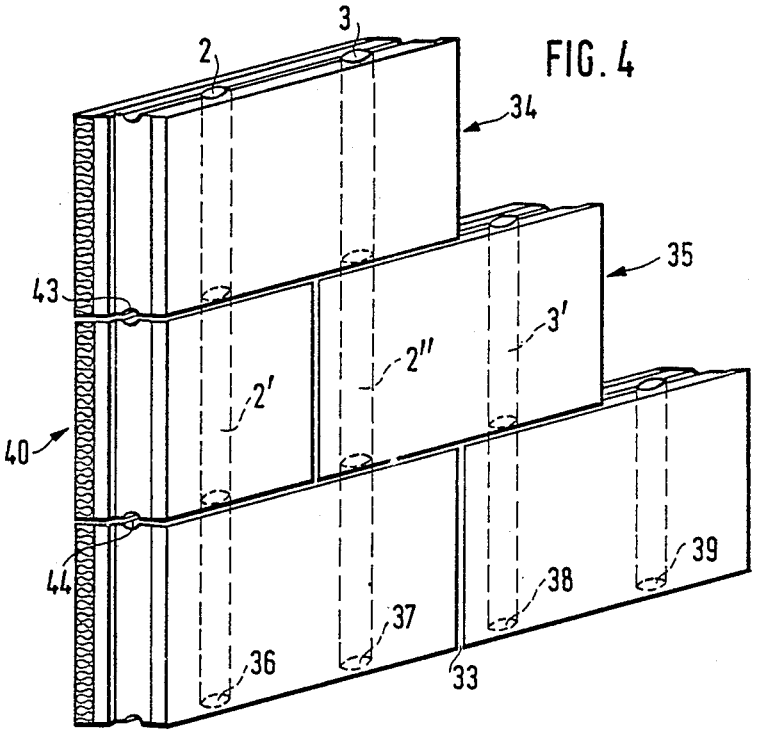

FIG. 4 a perspective view of a wall bond made using the prefabricated parts according to FIGS. 1 to 3.

FIG. 5 a view corresponding to FIG. 4 of part of a wall of a building erected using such prefabricated parts.

FIG. 6 a top view of the part of the outer wall provided with the window according to FIG. 5.

Figure 7:
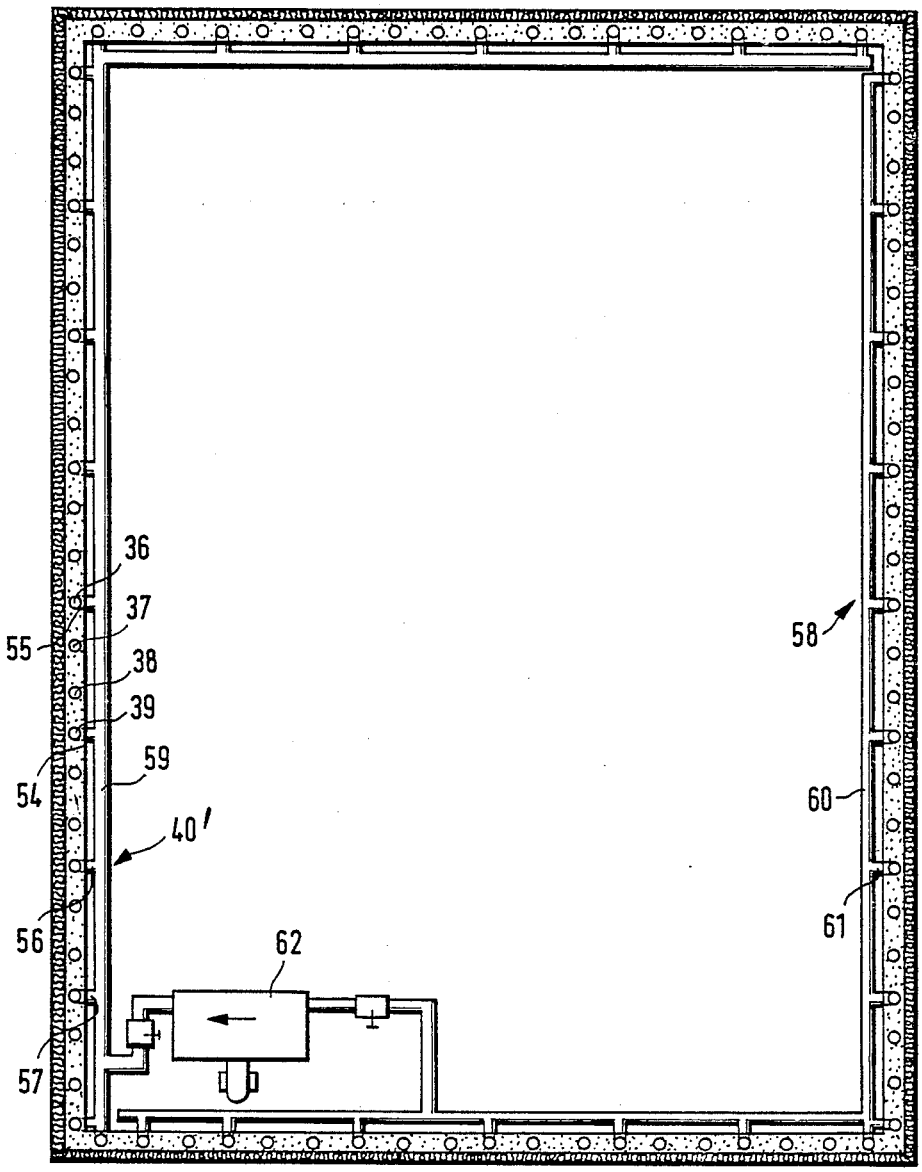

FIG. 7 a schematic view of a building according to the invention in order to illustrate the circulation of the medium.

Figure 8:
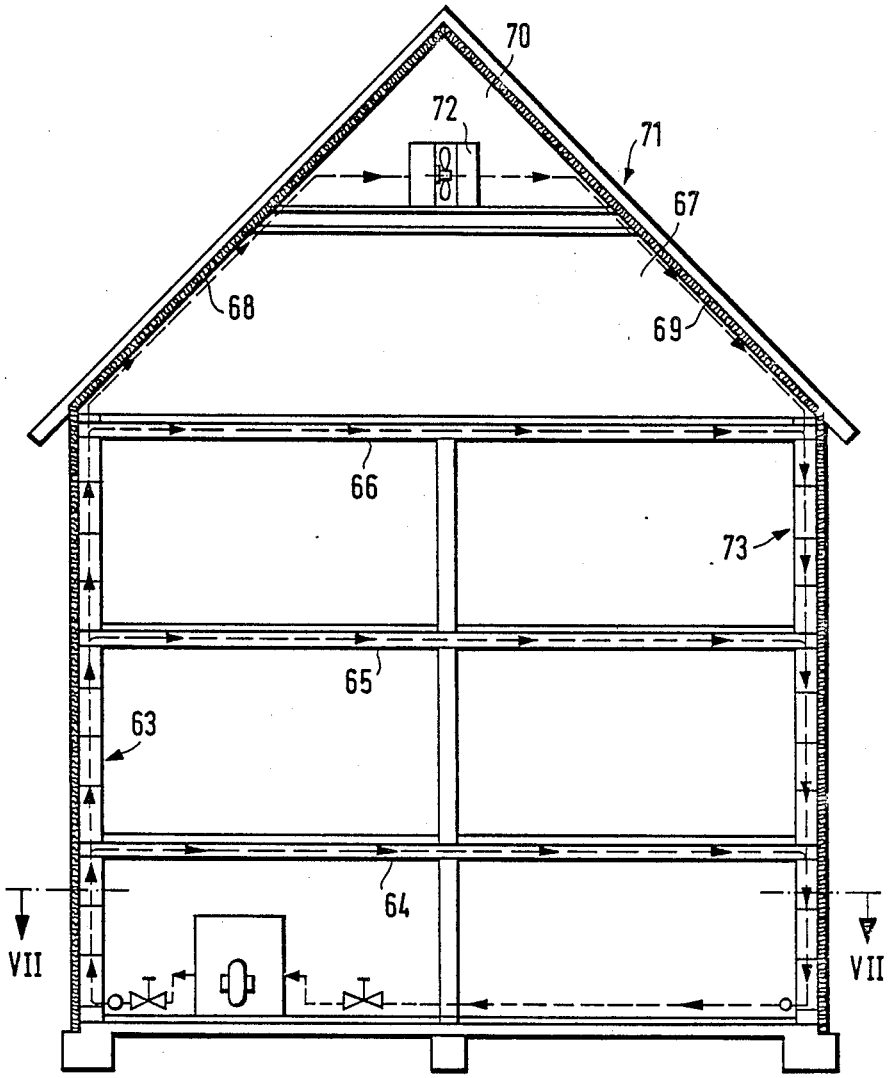

FIG. 8 a schematic view of a building according to the invention in order to illustrate the circulation of the medium.

Figure 9:
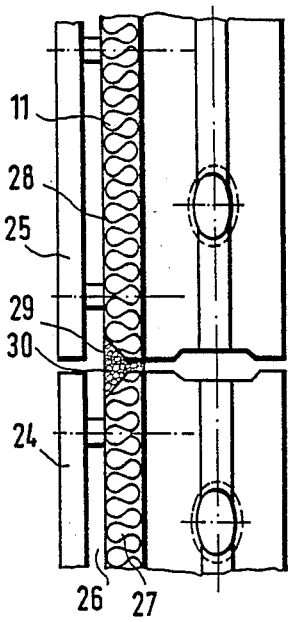

FIG. 9 a detail of the wall design along one of the joints of the brickwork.

Figure 10:
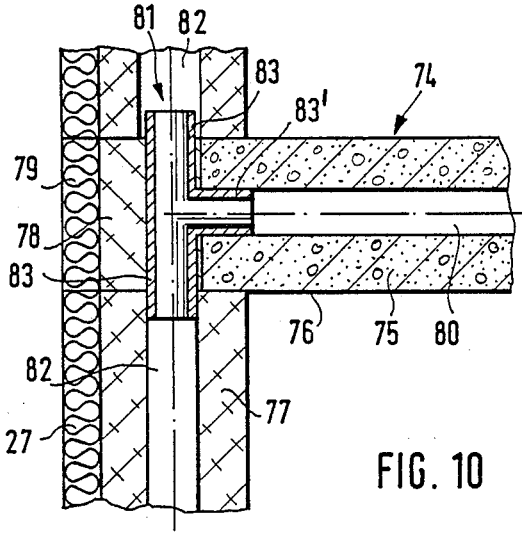

FIG. 10 part of a transverse beam with the adjacent ceiling in a building according to the invention, the parts being shown in a vertical section.

Figure 11:
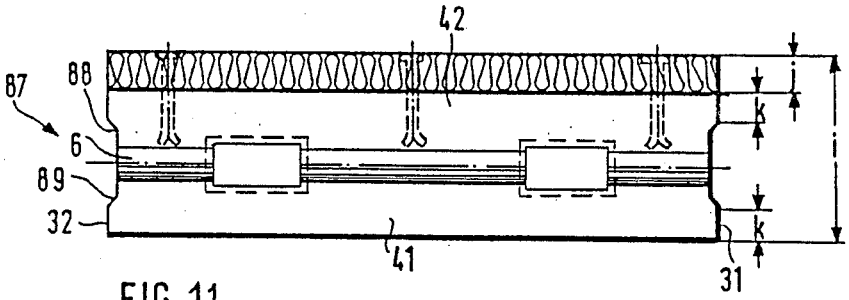

FIG. 11 a top view of a modification of the prefabricated part, and

Figure 12:
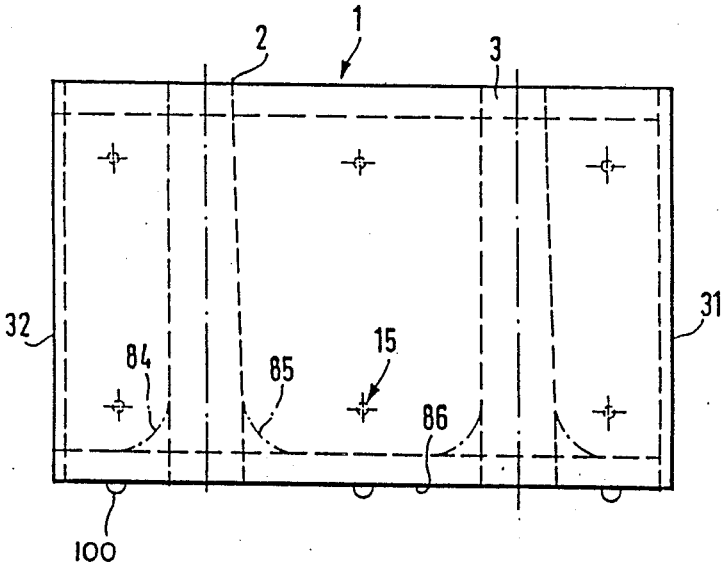

FIG. 12 a front view of the prefabricated part showing a further modification.

The prefabricated part shown in the drawings is formed by a large-format artificial brick 1. This brick has two recesses 2, 3 (FIG. 3) each forming a section of adjacent vertical wall channels, and a semitubular depression 6, 7 (FIG. 2) formed in each brick surface 4, 5 limiting the horizontal brickwork joints. These depressions are semicircular grooves so that a substantially circular cross-section is formed when the brickwork is constructed of two adjacent bricks. As can be seen in FIG. 3, this semitubular depression 6, 7 shows openings 8, 9 of recesses 2, 3, as shown by the example of semitubular depression 6.

To elucidate the format of the artificial brick according to the embodiment of FIGS. 1 to 3 of the invention, the following dimensions are stated by way of example:

a=1.0 m
b=24.75 cm
c=50.5 cm
d=12 cm
e=10 cm
f=64 cm
g=5 cm
h=1.5 cm
i=30 cm
j=6 cm
k=5 cm

The above-stated dimensions serve only as an example, of course. However, they state the average brick format which thus differs substantially from the so-called standard brick having edge lengths of 6.5×12×25 cm and whose dimensions are in the relation of 1:2:4.

On the side of the brick assigned to the subsequent facade side of the building (FIGS. 2 and 3), this side of the brick being referred to as 10 in FIG. 2, artificial brick 1 bears a thermally insulating plate which may be made of Styrofoam, for example, and is referred to as 11. As can be seen in FIG. 2, this plate is attached by aid of anchors 12, 14 which are distributed in accordance with the hole pattern indicated in FIG. 1 and identified by arrow 15. These anchors have flat heads 16, one anchor shaft 17 each and spread ends 18. Such an artificial brick may be made, for example, out of a mixture such as concrete. For this purpose, a shell mold is used, which is not shown but which shapes the narrow sides of the brick with its four walls. The thermally insulating plate 11 provided with anchors 12, 14 is inserted into the bottom of such a mold, flat anchor heads 16 being oriented toward the bottom of the mold. The mixture is then poured in and hardens around the shaft and end 17, 18 of each anchor.

Shaft 17 has a hollow design according to the embodiment of FIG. 2. It serves as a spreading sheath for a threaded shaft 20 of a bolt 21 with a hexagon head 22 and washer 23. A number of bolts 21 corresponding to the number of anchors 12, 14 is used according to the view of FIG. 9 to provide individual elements 24, 25 of a cold facade. This term commonly refers to a facade having an air gap 26 between the outside of the thermal insulation referred to in general as 27. Facade elements 24, 25 are cooled from behind by this convectional current and can therefore not be warped by exposure to sunlight. However, the design of a cold facade with elements 24, 25 designed as in FIG. 9 is not a necessary condition for realizing the invention. Warm facades can also be realized in which the facade elements lie immediately against the thermal insulation.

As can further be seen in the view of FIG. 9, the outer edges of thermally insulating plates 11 are canted off, as can be seen schematically at 28. This results in filling seams 30 at the joints of the brickwork, as shown at 29. The thermal insulation of the wall can be limited to the production of these filling seams 30 at the construction site. This is preferably done using a liquid thermosetting synthetic material.

If dimensions a to c stated at the outset are compared, this results in a certain arrangement of the two recesses 2, 3 for the vertical wall channels in artificial bricks 1. That is, each of recesses 2,3 is spaced away from the vertical joint side 31 or 32 (FIG. 2) adjacent thereto by approximately half its distance c away from the other recess, and the mutual distance c between recesses 2, 3 corresponds to the sum of their distances away from vertical joint sides 31, 32 plus the joint width. The width of these vertical joints, one of which is referred to as 33 in FIG. 4, may be relatively small. In the embodiment shown, it is 1 cm and thus allows, in the heading bond shown in FIG. 4, for automatic alignment of recesses 2, 3 of the respective upper layer 34 with the recesses shown at 2' or 2'' of the binder layer 35 located therebelow. This pattern also holds, of course, for recesses 3', which are aligned with recesses 2 of upper layer 34. In this manner, vertical wall channels 36 to 39 come about as in FIG. 4 when the heading bond, referred to in general as 40, is constructed. It can be reliably ruled out that joint mortar penetrates into the openings of recesses 2, 3 when the brickwork is being constructed because the distribution of the joint mortar can be limited to brick surfaces 41, 42 (FIG. 3) without making any particularly high demands on the skill of the mason. In horizontal joints 33 (FIG. 4) the subsequent connecting channels may be kept open in the joint mortar by tubes inserted into the horizontal connecting channels 43, 44 and subsequently removed. However, such tubes are not absolutely necessary. Contrivances may also be used to keep openings 8, 9 of vertical recesses 2, 3 open when the horizontal joints are being masoned, these contrivances possibly consisting of small steel plates which are pulled out after the binder layers have been constructed and before the joint mortar has completely hardened. The vertical joints otherwise do not contain any channels which must be kept open, with the exception of the connecting channels crossing them, whereby these crossings may be kept open in the same manner as the other channels.

The brickwork can be carried out in winter construction because hot air can be introduced into the openings of horizontal wall channels 43, 44 from a blower set up on the construction site, serving to heat the joints until the mortar has hardened.

As can also be seen in the view of FIG. 1, recesses 2, 3 have a conical design on one side, which is favorable for removing a form keeping these recesses open from the hardened brick.

At 84 and 85 in FIG. 1 the funnel-shaped extensions of an embodiment of the invention which are assigned to the lower joint side 86 are shown. In this embodiment the design of recesses 2, 3 serves the purpose of improving the flow through the horizontal wall channels into the vertical wall channels.

The view in FIG. 3 also indicates identical depressions 87 in the vertical joint sides, these depressions being groove-shaped. These grooves have a flat base area 88 and walls which point obliquely outward, one of which is referred to as 89. This causes the brickwork to be clamped at right angles to the wall when the vertical joints are subsequently filled in completely, insofar as these joints extend across the vertical joint surfaces 31, 32 of the bricks.

As shown in the view of FIG. 5, heat or cold bridges are avoided in the area of windows 45—and, if desired, in the area of doors. For this purpose, a soffit frame 46 which is also prefabricated of concrete or a different artificial stone is used (FIG. 6). This soffit frame bears on its facade surfaces a thermally insulating layer 47 which continues thermally insulating layer 27 of the outer front as far as the window soffit. Outer edges 48, 49 and 50, 51 (FIG. 5) located in the brickwork are provided with grooves 52, 53 forming vertical flow channels which are subjected to the heating medium via the horizontal channels which open thereinto. Corresponding grooves are formed in the horizontal sides of the frame members so that the entire soffit frame participates in heating the wall.

The view of FIG. 7 constitutes a cross-section along line VII—VII of FIG. 8. One can see the plurality of vertical flow channels for the gaseous heating medium arranged one close beside the other and indicated by reference numbers 36 to 39. The flow channels shown are adjacent vertical wall channels in which the heating circuit distribution is indicated. Heating circuit distributor 40' serves the purpose of supplying the heated heating medium, but only acts upon every third wall channel via a transverse bore 54, 55 and a connecting branch 56, 57 of distributor pipe 59 opening into said bore. This possibility of connecting only a fraction of the vertical wall channels at their lower end to heating circuit distributor 40' can be further exploited because horizontal wall channels 43, 44 ensure even distribution of the heating medium and thus the conveyance of the medium into the vertical wall channels not connected directly to the heating circuit distribution.

According to the view in FIGS. 7 and 8, the building is provided with an advance flow system which is fed via heating circuit distributor 40', and also has a return system fed via heating circuit distributor 58, thereby giving rise to a circulation of the medium. Heating circuit distributor 58 consists, like heating circuit distributor 40, of a main pipe 60 with outlets consisting of connecting branches 61 arranged at predetermined intervals, horizontal wall channels 43, 44 again ensuring the distribution of the returning medium into the vertical wall channels not connected to distributor 59. Apparatus 62 serves the purpose of heating the medium, in the case of climatic zones with low outdoor temperatures, this medium usually being air. It may also have a cooling apparatus at the same time, so that the house can be cooled in the summertime. The medium flows upward in advance flow conduit 63 (FIG. 8) through the vertical wall channels of the advance flow system, thereby partially crossing ceilings 64 to 66 of the building. Insofar as the flow regulated by fixed or adjustable restrictors reaches the attic, oblique walls 68, 69 present in the attic 67 completed for habitation are also acted upon by the heating medium in the manner which has already been described for the vertical walls. However, the roof will generally be lined with hollow boards which are appropriately insulated on the outside.

In the ridge area 70 of gable roof 71, which is not completed for habitation, there is a blower 72 which ensures forced circulation of the heating medium into the downwardly directed return system 73.

The connection of the hollow ceilings to the vertical and horizontal wall channels which is accordingly necessary can be seen in the view of FIG. 10. A hollow ceiling plate 74 made of reinforced concrete 75 in precast construction is used. This plate lies with its outer edge 76 on the binder layer of the brickwork shown at 77 and limits the conventional transverse beam 78 toward the inside, which in turn is provided with an insulating layer 79 which continues the outside insulation 27 of the brickwork. The parallel horizontal ceiling channels are connected singly, as can be seen by the example of horizontal ceiling channel 80 shown in FIG. 10, to the vertical wall channel shown in FIG. 10 and referred to as 82 therein by aid of T-shaped connecting pipes 81. These T-pieces 81 are located with both ends of their through pipes 83 in the mutually aligned recesses of the bricks forming the brick layer, and with their blind pipes 83' in the end of the horizontal ceiling channel involved.

The described restrictors for regulating the medium flow are expediently constructed in the lower branch of the vertical wall channel involved.

FIG. 11 shows an embodiment of the prefabricated part in which recesses 2 and 3 have a rectangular cross section. The recesses may be tapered in the same manner as the elliptical recesses shown in FIGS. 1 and 9.

FIG. 12 shows an embodiment of the prefabricated part having integral cams 100 along the lower surface of the part for determining the height of the horizontal joint formed in the wall.

I claim:

1. A prefabricated element for constructing a wall of a building, the wall having a fluid medium flowing therethrough for altering or maintaining the temperature within the building, said element comprising a brick-like element having dimensions in excess of those of a standard brick; said element having at least two spaced passages therewithin, said passages forming sections of vertical conduits for the medium when said element is incorporated in a wall, said passages being of a truncated conical configuration so that the small opening is at the upper end of the section and the larger opening is at the lower end of the section when the element is incorporated in a wall, each of said passages being spaced from the adjacent side of said element running parallel thereto by a distance approximately equal to one half its distance from the other passage and the spacing between said passages is the sum of the distances from said sides plus the width of a joint between the sides of adjacent elements when incorporated in a wall; said element having generally semicircular depressions in the surfaces of the element extending normal to said passages, said depressions intersecting the openings of said passages in said surfaces and forming sections of horizontal conduits for the medium when said element is incorporated in a wall; said element having a substantially homogeneous thermal insulating plate attached to one side thereof and covering the entire area of said side.

2. The prefabricated element according to claim 1 further defined as an element for constructing a wall having a facade, wherein said thermal insulating plate is attached by means of a plurality of anchors extending into said element and said plate, and wherein said anchors further form means for receiving bolts used to fasten the facade to the wall.

3. The prefabricated element according to claim 1 wherein said passages are funnel shaped adjacent one of said openings.

4. The prefabricated element according to claim 1 wherein said sides of said element have uninterrupted recesses therealong.

5. The prefabricated element according to claim 1 wherein said passages have an elliptical cross-section, the major axis of the elliptical cross-section of each of said passages being in alignment and lying parallel to the direction of spacing of said passages.

6. The prefabricated element according to claim 1 wherein said passages have a rectangular cross-section, the longer sides of said rectangular cross-sections lying parallel to the direction of spacing of said passages.

7. The prefabricated element according to claim 1 wherein said surface of said element that forms the lower surface of said element when said element is incorporated into the wall contains a plurality of integrally formed cams for determining the height of the horizontal joint formed in the wall along said surface.

8. A building having a plurality of spaced vertical passages and horizontal conduits in the walls thereof through which flow a fluid medium for altering or maintaining the temperature within the building, said building including, walls formed of a plurality of prefabricated elements bonded together with mortar with said passages and conduits being free of mortar, each of said elements comprising a brick-like element having dimensions in excess of those of a standard brick; said element having at least two spaced passages therewithin, said passages forming sections of said vertical conduits for the medium, said passages being of a truncated conical configuration so that the small opening is at the upper end of the section and the larger opening is at the lower end of the section, each of said passages being spaced from the adjacent side of said element running parallel thereto by a distance approximately equal to one half its distance from the other passage and the spacing between said passage is the sum of the distances from said sides plus the width of a joint between the sides of adjacent element; said element having generally semicircular depressions in the surfaces of the element extending normal to said passages, said depressions intersecting the openings of said passages in said surfaces and forming sections of said horizontal conduits for the medium;

said element having a substantially homogeneous thermal insulating plate attached to one side thereof and covering the entire area of said side;

supply duct means coupled to a selected first number of said vertical passages for supplying the fluid medium thereto;

return conduit means coupled to a selected second number of said vertical passages for receiving the fluid medium therefrom;

fluid circulating means coupled to said supply duct means and said return duct means for flowing fluid through said passages and conduits; and connection means connecting said first number of passages and said second number of passages for completing a flow path for the fluid medium.

9. The building according to claim 8 further including a member connecting two or more of said walls and wherein said connection means comprises conduit means formed in said member.

10. The building according to claim 8 wherein said member comprises a generally horizontal member.

11. The building according to claim 8 wherein said member comprises, at least in part, a pitched roof member.

12. The building according to claim 8 further including a soffit frame in at least one of said walls, said soffit having passages and conduits communicating with said passages and conduits in said wall.

* * * * *